US008795444B1

(12) United States Patent
Kisner et al.

(10) Patent No.: US 8,795,444 B1
(45) Date of Patent: Aug. 5, 2014

(54) METHOD OF AND APPARATUS FOR THERMOMAGNETICALLY PROCESSING A WORKPIECE

(71) Applicant: UT-Battelle, LLC, Oak Ridge, TN (US)

(72) Inventors: Roger A. Kisner, Knoxville, TN (US); Orlando Rios, Knoxville, TN (US); John B. Wilgen, Oak Ridge, TN (US); Gerard M. Ludtka, Oak Ridge, TN (US); Gail M. Ludtka, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 14/186,385

(22) Filed: Feb. 21, 2014

(51) Int. Cl.
*B21K 17/00* (2006.01)
*F25B 21/00* (2006.01)
*B21D 17/00* (2006.01)

(52) U.S. Cl.
USPC ..... 148/403; 148/561; 72/54; 72/700; 62/3.1; 62/3.7; 62/118; 29/419.2; 29/522.1

(58) Field of Classification Search
USPC ..... 148/403, 561, 672; 62/3.1, 3.2, 3.3, 3.7, 62/118, 190, 467, 914; 72/54, 56, 333, 72/336, 363, 364, 700; 29/419.2, 522.1
See application file for complete search history.

(56) References Cited

U.S. PATENT DOCUMENTS

| | | | | |
|---|---|---|---|---|
| 4,910,371 | A | 3/1990 | Brun et al. | |
| 5,068,512 | A * | 11/1991 | Van Geel et al. | 219/121.6 |
| 5,477,035 | A | 12/1995 | Matsumoto et al. | |
| 6,229,126 | B1 | 5/2001 | Ulrich et al. | |
| 6,346,690 | B1 | 2/2002 | Ulrich et al. | |
| 6,576,877 | B2 | 6/2003 | Dabelstein et al. | |
| 7,078,660 | B2 | 7/2006 | Mitamura et al. | |
| 7,161,124 | B2 | 1/2007 | Kisner et al. | |
| 7,542,313 | B2 | 6/2009 | Osaka | |
| 7,745,765 | B2 | 6/2010 | Kisner et al. | |
| 8,499,598 | B2 * | 8/2013 | Johnson et al. | 72/54 |
| 2009/0217674 | A1 * | 9/2009 | Kaji et al. | 62/3.1 |
| 2011/0248019 | A1 | 10/2011 | Chew | |
| 2012/0324908 | A1 * | 12/2012 | Ludtka et al. | 62/3.1 |
| 2013/0025814 | A1 * | 1/2013 | Demetriou et al. | 164/250.1 |

FOREIGN PATENT DOCUMENTS

CN 201039505 3/2008

OTHER PUBLICATIONS

Ganapathysubramanian, et al., "Using Magnetic Field Gradients to Control the Directional Solidification of Alloys and the Growth of Single Crystals," *Journal of Crystal Growth*, 270 (2004) pp. 255-272.

(Continued)

*Primary Examiner* — David B Jones
(74) *Attorney, Agent, or Firm* — Brinks Gilson & Lione

(57) ABSTRACT

A method of thermomagnetically processing a material includes disposing a workpiece within a bore of a magnet; exposing the workpiece to a magnetic field of at least about 1 Tesla generated by the magnet; and, while exposing the workpiece to the magnetic field, applying heat energy to the workpiece at a plurality of frequencies to achieve spatially-controlled heating of the workpiece. An apparatus for thermomagnetically processing a material comprises: a high field strength magnet having a bore extending therethrough for insertion of a workpiece therein; and an energy source disposed adjacent to an entrance to the bore. The energy source is an emitter of variable frequency heat energy, and the bore comprises a waveguide for propagation of the variable frequency heat energy from the energy source to the workpiece.

23 Claims, 4 Drawing Sheets

(56) References Cited

OTHER PUBLICATIONS

Ludtka, G.M. et al., "Final Technical Report: Magnetic Field Processing—A Heat Free Heat Treating Method," Oak Ridge National Laboratory, Oak Ridge, TN (Aug. 8, 2012) pp. 1-73, available from U.S. Department of Energy Information Bridge: www.osti.gov/bridge.

Ludtka, G.M. et al., "In Situ Evidence of Enhanced Transformation Kinetics in a Medium Carbon Steel Due to a High Magnetic Field," *Scripta Materialia*, 51 (2004) pp. 171-174.

Nicholson, D.M.C. et al., "The Effect of High Magnetic Field on Phase Stability in Fe-Ni," *Journal of Applied Physics*, 95 11 (2004) pp. 6580-6582.

* cited by examiner

METHOD OF AND APPARATUS FOR THERMOMAGNETICALLY PROCESSING A WORKPIECE

FEDERALLY SPONSORED RESEARCH OR DEVELOPMENT

The invention described in this disclosure arose in the performance of Prime Contract Number DE-AC05-000R22725 between UT-Battelle, LLC and the Department of Energy. The government has certain rights in this invention.

TECHNICAL FIELD

The present disclosure is related generally to magnetic field processing and more particularly to the processing of materials using a combination of a high strength magnetic field and selective heating.

BACKGROUND

Processing materials in a high magnetic field is proving to be an efficient means of creating materials with excellent structural properties arising from a new method of tailoring microstructure. Properties equivalent to those of materials treated by conventional thermal methods can be achieved with significantly less energy input and in shorter processing times. In addition, new properties can be arrived at by manipulation of phase stability through the application of ultrahigh magnetic fields.

The ability to selectively control microstructural stability and alter transformation kinetics through appropriate selection of the magnetic field strength is being shown to provide a very robust and efficient mechanism to develop enhanced microstructures with superior properties.

A key component of material treatment is the ability to rapidly heat and cool a sample inside the bore of an ultra-high field magnet. Methods such as induction and resistive heating of samples either directly or indirectly through a susceptor chamber may allow such rapid heating. Spatial control over the heating of the samples is also important. It would be advantageous to be able to accomplish heating in a wide range of materials having various properties and to control that heating to specific regions of the sample.

BRIEF SUMMARY

An apparatus for thermomagnetically processing a material comprises: a high field strength magnet having a bore extending therethrough for insertion of a workpiece therein; and an energy source disposed adjacent to an entrance to the bore. The energy source is an emitter of variable frequency heat energy, and the bore comprises a waveguide for propagation of the variable frequency heat energy from the energy source to the workpiece.

A method of thermomagnetically processing a material includes disposing a workpiece within a bore of a magnet; exposing the workpiece to a magnetic field of at least about 1 Tesla generated by the magnet; and, while exposing the workpiece to the magnetic field, applying heat energy to the workpiece at a plurality of frequencies to achieve spatially-controlled heating of the workpiece.

DETAILED DESCRIPTION

A novel method of and apparatus for thermomagnetically processing a workpiece that may shorten the total processing time, reduce the amount of energy used and improve the performance of the final part is described herein. The new method combines exposure to an ultrahigh magnetic field with the application of heat energy of a variable frequency to effect spatially controlled heating of a workpiece. The variable frequency heat energy may target specific penetration depths, crystallographic phases with distinct electrical and/or magnetic properties or other regions of the workpiece while the workpiece is under the effect of a high field strength magnetic field. The novel apparatus utilizes the bore of a high field strength magnet to provide a waveguide for directing the variable frequency heat energy from an energy source to the workpiece.

Figure 1:
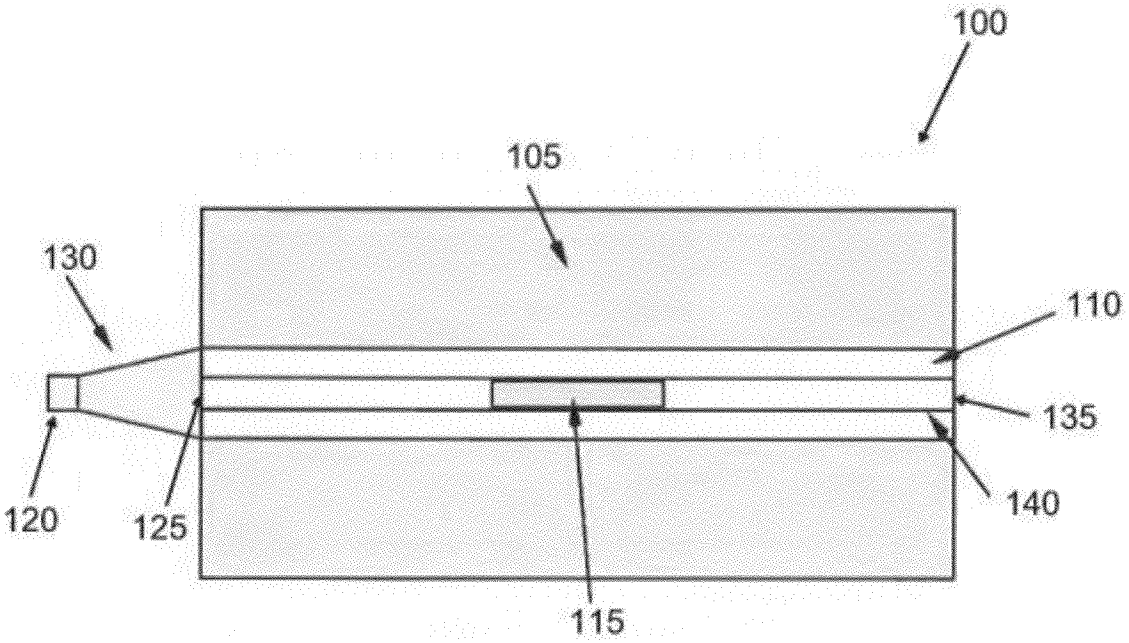
FIG. 1 shows a schematic of a workpiece in a bore of a magnet undergoing heating while exposed to a high field strength magnetic field, where the bore serves as a waveguide for propagation of heat energy from the energy source to the workpiece.

Referring to FIG. 1, the apparatus 100 includes (a) a high field strength magnet 105 having a bore 110 extending therethrough for insertion of a workpiece 115 therein and (b) an energy source 120 disposed adjacent to an entrance 125 to the bore 110. In this example, the bore 110 itself is a waveguide for propagation of the heat energy from the energy source 120 to the workpiece 115. A non-conductive sample holder or liner 140 may be disposed within the bore 110 to hold the workpiece 115. The heat energy generated by the energy source 120 may comprise acoustic energy or electromagnetic radiation that is varied in frequency during the magnetic processing of the workpiece 115. The energy emitted by the energy source is referred to as "heat energy" in the present disclosure due to the heating effect imparted to the workpiece as a consequence of interaction with the acoustic waves or the electromagnetic radiation. In addition, the phrase "heat energy comprising a plurality of frequencies" may be understood to have the same meaning as "variable frequency heat energy" throughout this disclosure.

Figure 2A:
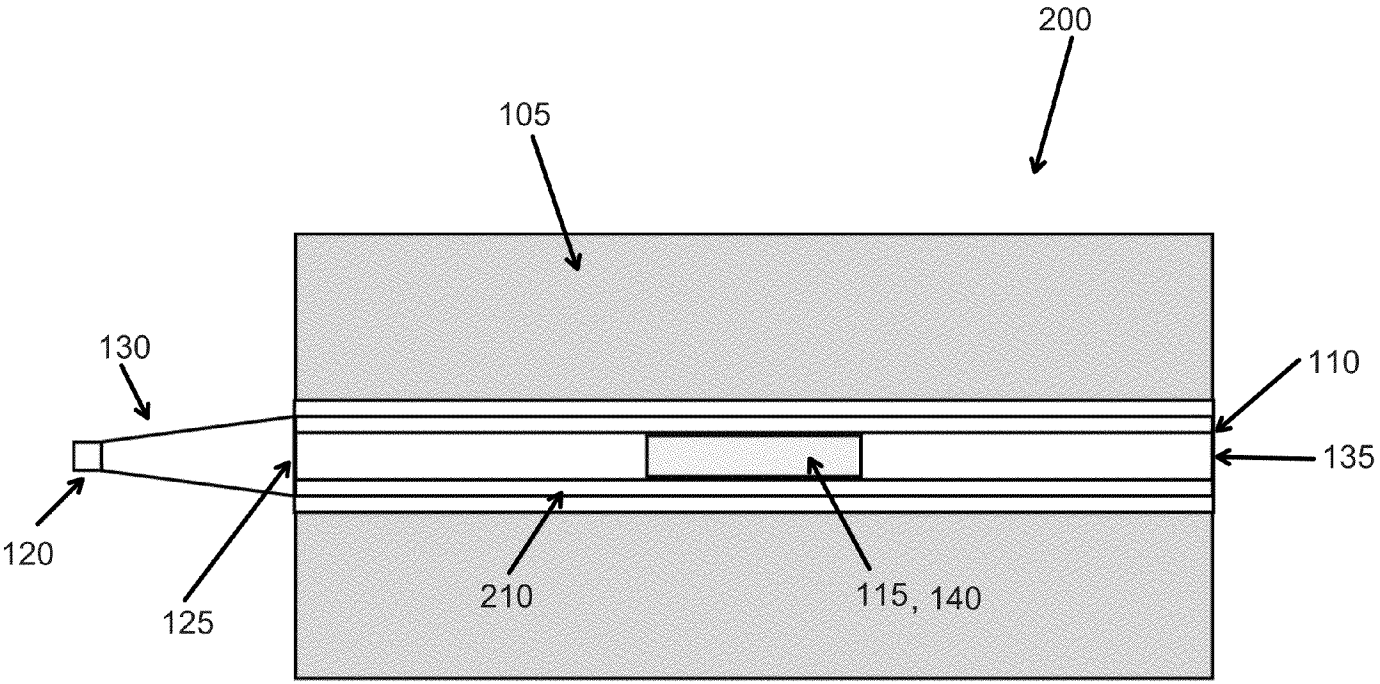
FIGS. 2A and 2B show schematics of a workpiece in a bore of a magnet undergoing heating while exposed to a high field strength magnetic field, where a separate conduit is positioned in the bore to function as the waveguide.
Figure 2B:
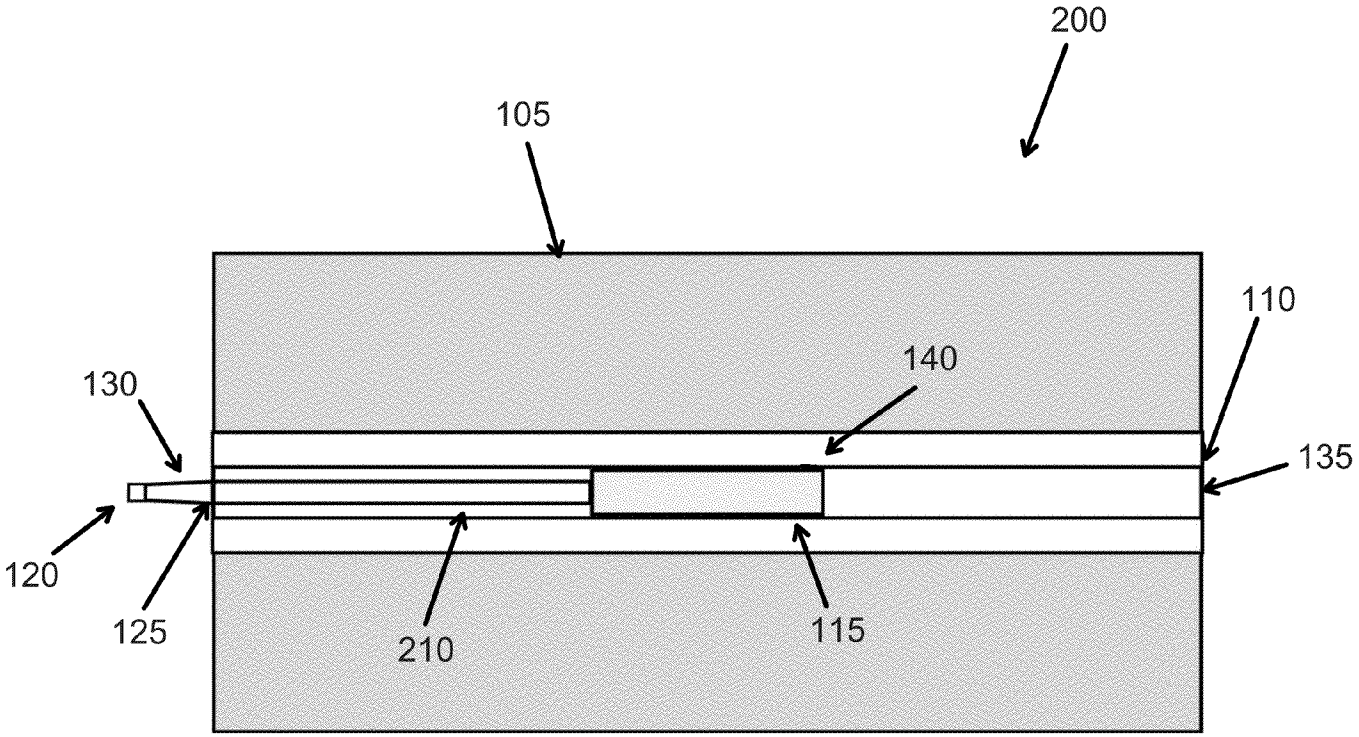

Referring to FIGS. 2A and 2B, the apparatus 200 includes (a) a high field strength magnet 105 having a bore 110 extending therethrough for insertion of a workpiece 115 therein and (b) an energy source 120 disposed adjacent to an entrance 125 to the bore 110. In these examples, the bore 110 includes a separate conduit 210 that functions as the waveguide for propagation of the heat energy from the energy source 120 to the workpiece 115. A non-conductive sample holder or liner 140 may be disposed within the bore 110 to hold the workpiece 115. In FIG. 2A, the conduit 210 is smaller in diameter than the bore 110, but larger in size than the sample holder (e.g., a quartz tube) 140 holding the workpiece 115. In FIG. 2B, a separate conduit 210 is positioned inside of a liner 140 that holds the workpiece 115. As in the previous embodiment, heat energy generated by the energy source 120 may comprise acoustic energy or electromagnetic radiation that is varied in frequency during the magnetic processing of the workpiece 115.

Typically, the high field strength magnet 105 is a magnet capable of producing high magnetic fields of about 1 Tesla. The magnet may be a superconducting electromagnet or another type of magnet, such as a permanent magnet, resistive magnet (e.g., Bitter magnet), nonsuperconducting electromagnet, and/or hybrid magnet that can generate a magnetic field at or above 1 Tesla. For some applications, it may be advantageous to employ a magnet capable of generating a magnetic field of at least about 5 Tesla, at least about 10 Tesla, at least about 30 Tesla, or at least about 50 Tesla; typically, the field generated by the magnet does not exceed about 150 Tesla, and the field may also not exceed 100 Tesla.

The bore 110 of the magnet 105 may comprise a waveguide for propagation of the heat energy from the energy source 120 to the workpiece 115. As illustrated in FIGS. 1 and 2, the bore 110 of the magnet 105 may be the waveguide or the bore 110 may include a separate conduit 210 of a smaller diameter or width that is placed within the bore 110 to function as the waveguide. The wall thickness of the conduit 210 may be appropriately chosen so that the conduit 210 may fit within the bore 110 of the magnet 105 while providing the desired (inner) diameter or width to function as the waveguide. Typically, the waveguide (bore 110 or conduit 210) is made of a conductive material (e.g., a metal such as aluminum). The waveguide is typically hollow, although, as described below, the waveguide may contain a gaseous, liquid or solid medium depending on the energy source employed. Generally, the waveguide has a circular or a rectangular transverse cross-section.

As would be recognized by one of ordinary skill in the art, the width or diameter of a waveguide may be the same order of magnitude as the wavelength of the guided wave. Accordingly, larger-diameter bores or conduits can best serve as waveguides for lower frequency waves, while smaller-diameter bores or conduits may be advantageous for guiding higher frequency waves. Accordingly, for a given size of magnet and bore/conduit diameter/width, it may be possible to identify a preferred type or types of heat energy and frequencies to be employed during processing. Also, the type of heat energy and frequencies to be employed may determine if a waveguide of a particular size should be inserted into a bore of a given diameter for transmission of the heat energy to the workpiece. These scenarios are described further below.

The energy source 120 may be an electromagnetic radiation source (e.g., microwave source, radiofrequency source, millimeter-wave source, laser source, infrared source, visible or ultraviolet radiation (UV) source) or an acoustic source. A schematic of an exemplary energy source is shown in FIGS. 1 and 2. The energy source 120 may be disposed outside the bore 110 and/or conduit 210, as shown. In such a case, the energy source 120 may be attached to the entrance 125 to the bore 110 or conduit 210 by a coupling 130, which may, in addition to serving a mechanical function in connecting the energy source 120 to the bore 110 or conduit 210, facilitate transmission of the heat energy from the energy source 120 to the workpiece 115. Alternatively, the energy source 120 may be positioned inside the bore 110 and/or conduit 210. It is contemplated that a second energy source may also be included as part of the apparatus. In such an embodiment, the second energy source may be positioned at the opposing end 135 of the bore 110. Similar to the first energy source, the second energy source may be disposed outside the bore/conduit and coupled to the bore/conduit by a coupling. Alternatively, the second energy source may be positioned inside the bore/conduit. Any description provided herein for the "energy source" is applicable to either or both of the first energy source and the optional second energy source.

Figure 3:
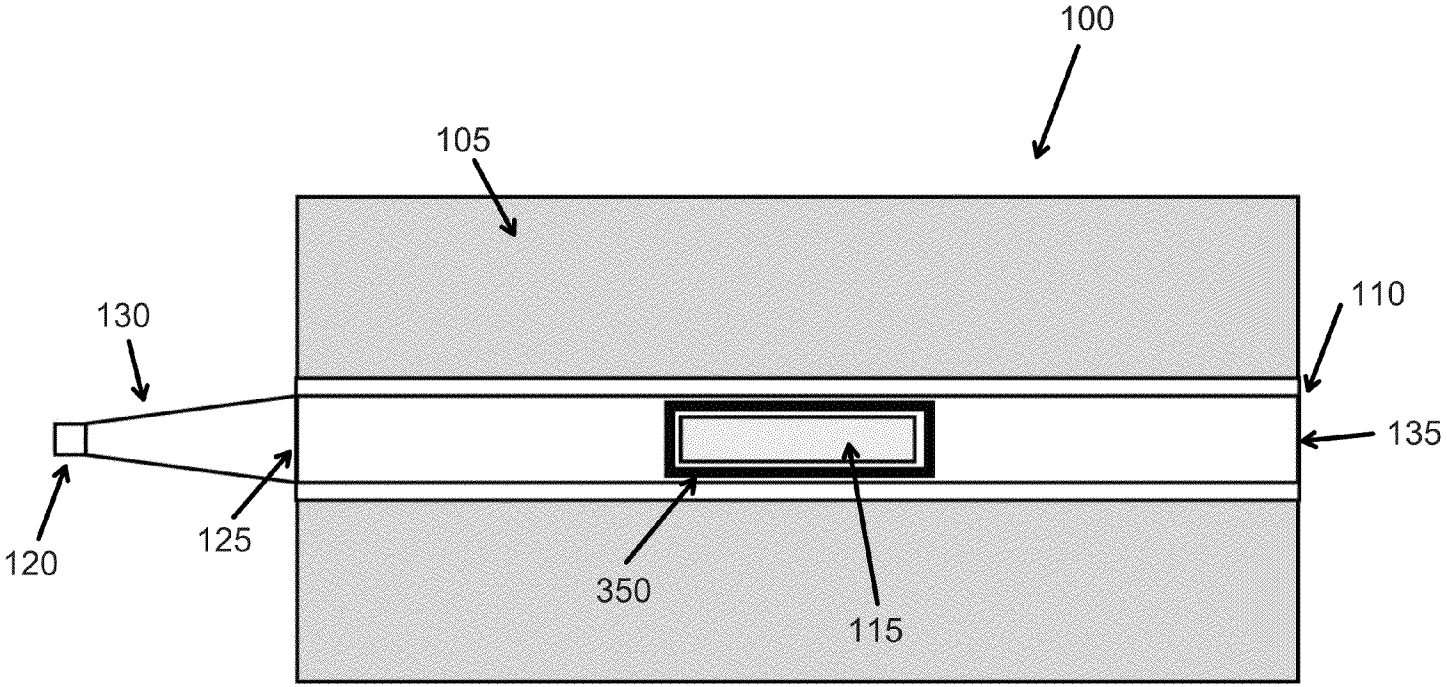
FIG. 3 shows a schematic of a workpiece in a bore of a magnet undergoing heating while exposed to a high strength magnetic field, where the workpiece is surrounded by a susceptor.

The workpiece 115 can be heated directly by the heat energy from the energy source, or the bore 110 of the magnet 105 may further include a susceptor 350 adjacent to and/or in contact with the workpiece 115, as illustrated in FIG. 3. The susceptor 350 can absorb electromagnetic radiation or acoustic energy and convert it into heat energy. In such a case, the susceptor 350 may transfer the heat energy from the energy source to the workpiece 115 by means of heat conduction, heat convection, or infrared radiation, or by a combination of these. In addition, in order to obtain a desired heat distribution over the surface of the workpiece 115, electromagnetic shielding may be used to control the location and/or rate of heating. For example, electromagnetic shielding may prevent the heat energy (at RF or microwave frequencies) from heating certain parts of the surface of the workpiece, or it may reduce the heating rate at certain locations on the workpiece, or otherwise provide a means for manipulating the heat distribution over the workpiece. For example, electromagnetic shielding may be used to improve the uniformity of the heating.

The heat energy from the energy source 120 may comprise frequencies within the range of from a few Hz to tens of GHz. For example, the frequencies may range from about 0.5 Hz to about 100 Hz, from about 10 Hz to about 100 MHz, from about 100 MHz to about 500 MHz, from about 500 MHz to 1 GHz, and/or from about 1 GHz to about 100 GHz. According to one embodiment, the heat energy includes microwave energy having frequencies in the range of from about 0.5 Hz to about 30 GHz. According to another embodiment, the heat energy includes acoustic energy having frequencies in the range of from about 10 Hz to about 1 MHz. Depending on the energy source, much higher frequencies may be produced. For example, the heat energy may be produced by a laser source having frequencies in the teraherz (THz) range. Laser heating of the workpiece might be accomplished by using any infrared and/or visible lasers known in the art and commonly used for laser cutting, laser drilling, and laser welding applications. For example, a long wavelength infrared laser, such as a $CO_2$ gas laser (10 micron wavelength) may have a frequency of about 30,000 GHz (30 THz), while a Nd:YAG solid state laser (1060 nm wavelength) may have a frequency of about 280 THz. Thus, according to another embodiment, the heat energy may be infrared energy produced by a laser source at frequencies in the range of from about 10 THz to about 400 THz. Alternatively, the heat energy may be visible light energy produced by a laser source at frequencies in the range of from about 400 THz to about 800 THz.

When the heat energy comprises electromagnetic energy, the bore 110 of the magnet 105 may serve as a waveguide for frequencies (f) above a cutoff frequency ($f_c$), $f>f_c$. As would be recognized by one of ordinary skill in the art, at a frequency above the cutoff frequency, the waveguide may transmit the heat energy, and at a frequency below the cutoff frequency, the waveguide may attenuate or block the heat energy. The cutoff frequency for a waveguide having a circular cross-section of radius $\alpha$ is represented by $$f_c = \frac{1.8412}{2\pi a\sqrt{\mu\varepsilon}} = \frac{1.8412c}{2\pi a},$$

where c is the speed of light within the waveguide, $\mu$ is the permeability of the environment within the waveguide, and $\epsilon$ is the permittivity of the environment within the waveguide. For example, $f_c$ may be about 1 GHz for a bore radius a of about 7.5 cm for an air environment. For lower frequencies, $f<f_c$, a multi-conductor transmission line may be used within the bore 110 to couple electromagnetic energy to the location of the workpiece 115. For example, a coaxial line may feed an induction coil. For higher frequencies, $f>>f_c$ (e.g., f above 2 GHz), a smaller waveguide 210 may be positioned within the bore 110 of the magnet 105 to deliver the heat energy to the location of the workpiece 115. For a waveguide having a rectangular cross-section of dimensions a and b, the following formula for the cutoff frequency applies:

$$f_c = \frac{1}{2a\sqrt{\mu\varepsilon}} = \frac{c}{2a},$$

where the snort length b of the waveguide does not influence the cutoff frequency. The electromagnetic radiation source may take the form of an induction coil, an electromagnetic acoustical transducer, a single-mode microwave cavity resonator with separate E-field and H-field regions, and/or a microwave oven having a multi-mode microwave cavity.

The bore of the magnet may also function as an acoustic waveguide for an acoustic energy source. In some cases, a separate conduit may be positioned within the bore of the magnet to serve as the acoustic waveguide for the transmission of acoustic energy from the energy source to the workpiece. To transmit the acoustic energy with optimal efficiency, the bore or acoustic waveguide may contain a sound transmitting medium, which may be a gas, liquid or solid. The acoustic energy source may comprise a piezoelectric-driven actuator, a magnetic-driven actuator, an air- or gas-driven actuator, a hydraulic actuator, or a mechanically actuated device. The acoustic energy from the source can be coupled to the workpiece via a horn or an acoustical cavity resonator. Alternatively, the acoustical energy can be created at the workpiece location by means of an EMAT device.

Depending on the type of energy used, it may be beneficial to maintain a controlled environment within the bore of the magnet (and/or within the conduit) during processing. The controlled environment may be a vacuum environment (e.g., $10^{-2}$ Torr or better, or $10^{-5}$ Torr or better), a low-pressure inert or reactive gas environment, or an atmospheric-pressure inert or reactive gas environment. Suitable inert gases may include helium or argon. The controlled environment may also or alternatively include a liquid or solid for effective transmission of the heat energy if, for example, an acoustic energy source is used as described above. Suitable liquids may include, for example, oil (mineral, silicone, or hydrocarbon), water, an aqueous solution, or an alcohol, or a solid such as fine particulate insulation (e.g., silicon-based or polystyrene insulation). It is possible that the bore (or conduit within the bore) may form a resonator. The characteristics of the gas and its pressure may help to determine the resonant frequency and efficiency of coupling of energy to the workpiece.

To carry out the method of thermomagnetically processing a material as described herein, a workpiece is disposed within a bore of a magnet and the workpiece is exposed to a magnetic field of at least about 1 Tesla generated by the magnet. While the workpiece is exposed to the magnetic field, heat energy is applied to the workpiece at a plurality of frequencies to achieve spatially-controlled heating of the workpiece, where the penetration depth of the heat energy within the workpiece may be controlled.

In some embodiments, the magnetic field may be at least about 5 Tesla, at least about 10 Tesla, at least about 30 Tesla, or at least about 50 Tesla. Typically, the magnetic field is no higher than about 100 Tesla, or no higher than about 150 Tesla.

As set forth above, the heat energy may include acoustic energy and/or electromagnetic radiation, including radiofrequency, microwave, millimeter-wave, infrared, visible and/or UV radiation. The plurality of frequencies may lie with the range of a few Hz to tens of GHz. For example, the frequencies may range from about 0.5 Hz to about 100 Hz, from about 10 Hz to about 100 MHz, from about 100 MHz to about 500 MHz, from about 500 MHz to 1 GHz, and/or from about 1 GHz to about 100 GHz. According to one embodiment, the heat energy includes microwave energy having frequencies in the range of from about 0.5 Hz to about 30 GHz. According to another embodiment, the heat energy includes acoustic energy having frequencies in the range of from about 10 Hz to about 1 MHz. In yet another embodiment, the heat energy includes radiofrequency energy having frequencies in the range of from about 1 kHz to about 500 MHz. It is also contemplated that the heat energy may be infrared energy in the range of from about 10 THz to about 400 THz. Alternatively, the heat energy may be visible light energy at frequencies in the range of from about 400 THz to about 800 THz.

Depending on the selection of the plurality of frequencies and the speed with which the frequencies are varied during processing, the workpiece may be heated uniformly throughout the thickness, or heterogeneously (e.g., as a function of depth, as a function of phase composition, etc.). Lower frequencies are associated with increased penetration depths, and higher frequencies with shallower penetration depths. The plurality of frequencies may be varied arbitrarily or according to a predetermined pattern.

According to one embodiment, the plurality of frequencies may vary cyclically as a function of time between maximum and minimum values. For example, the frequencies may follow a sinusoidal pattern as a function of time. If the frequency is varied rapidly enough, this approach may allow uniform heating to be achieved throughout the thickness of a workpiece. Alternatively, for slower cycling between maximum and minimum values of frequency, this approach may allow for controlled heating and reheating of successive layers of the workpiece. The modulation rate, or speed at which the frequency is cycled between maximum and minimum values, may depend on the workpiece composition and may be assumed to lie in the range of from about 0.01 Hz to about 1 GHz, or from about 1 Hz to about 100 kHz. The modulation rate may also lie within one or more of the following ranges: from about 0.01 Hz to about 1 kHz, from about 10 Hz to about 10 kHz, or from about 1 kHz to about 1 GHz.

According to another embodiment, the plurality of frequencies may vary monotonically as a function of time. For example, the frequencies may follow a monotonically increasing or monotonically decreasing pattern, such as a linear function, a step function, or an exponentially increasing or decreasing function. In such a case, the heat energy may be targeted to different depths of the workpiece, allowing for selective heating of different layers.

It is also contemplated that the plurality of frequencies may exhibit a variation determined in-situ by measurement of one or more workpiece characteristics (e.g., temperature, resistivity, sound velocity, and/or dimensional change). This approach could be used, for example, to sense phase changes occurring during solid-state processing in the high field strength magnetic field and provide the necessary feedback to direct heat energy of an appropriate frequency to a particular phase (at a particular penetration depth), as determined by resistivity measurements.

In addition to the frequency of the heat energy, the amplitude of the heat energy may also be varied. The amplitude is the intensity of the heat energy. In the case of electromagnetic energy, the amplitude may be considered to be the flux, the number of photons per square centimeter per second. The energy can be cycled as an off-on parameter or continuously as a sinusoidal wave. Simultaneous frequencies can be applied to cause simultaneous heating at different layers or of different materials in the workpiece.

The workpiece may comprise a metallic, ceramic, semiconducting, polymeric and/or organic or other material (e.g., a food product).

The method may be carried out by employing the apparatus shown schematically in FIG. 1 or 2, where at least one energy source is disposed adjacent to an entrance to the bore of a high field strength magnet, and where applying heat energy to the workpiece comprises activating the heat source to emit variable frequency heat energy. As described above, the bore comprises a waveguide for propagation of the heat energy from the heat source(s) to the workpiece. In some cases the waveguide is the bore of the magnet, and in other cases the waveguide is a separate conduit placed within the bore of the magnet. It may be beneficial in some embodiments to move the workpiece within the bore during the application of the heat energy to facilitate heating.

Although the present invention has been described in considerable detail with reference to certain embodiments thereof, other embodiments are possible without departing from the present invention. The spirit and scope of the appended claims should not be limited, therefore, to the description of the preferred embodiments contained herein. All embodiments that come within the meaning of the claims, either literally or by equivalence, are intended to be embraced therein.

Furthermore, the advantages described above are not necessarily the only advantages of the invention, and it is not necessarily expected that all of the described advantages will be achieved with every embodiment of the invention.

The invention claimed is:

1. A method of thermomagnetically processing a material, the method comprising:

disposing a workpiece within a bore of a magnet;

exposing the workpiece to a magnetic field of at least about 1 Tesla generated by the magnet; and while exposing the workpiece to the magnetic field, applying heat energy to the workpiece at a plurality of frequencies to achieve spatially-controlled heating of the workpiece.

2. The method of claim 1, wherein the heat energy comprises at least one of: radiofrequency radiation, microwave radiation, millimeter wave radiation, infrared radiation, visible light, ultraviolet radiation, and acoustic energy.

3. The method of claim 1, wherein the plurality of frequencies lie in one or more of the following ranges: from about 0.5 Hz to about 100 Hz, from about 10 Hz to about 100 MHz, from about 100 MHz to about 500 MHz, from about 500 MHz to 1 GHz, from about 1 GHz to about 100 GHz, from about 10 THz to about 400 THz, and from about 400 THz to about 800 THz.

4. The method of claim 1, wherein the plurality of frequencies comprise ultrasonic frequencies in the range of from about 0.5 Hz to about 30 GHz.

5. The method of claim 1, wherein the plurality of frequencies comprise acoustic frequencies in the range of from about 10 Hz to about 1 MHz.

6. The method of claim 1, wherein the plurality of frequencies vary cyclically as a function of time.

7. The method of claim 1, wherein the plurality of frequencies vary monotonically as a function of time.

8. The method of claim 1, wherein the plurality of frequencies comprise a variation determined in-situ by measurement of one or more characteristics of the workpiece.

9. The method of claim 1, wherein, during application of the heat energy to the workpiece, the workpiece is heated substantially uniformly.

10. The method of claim 1, wherein, during application of the heat energy to the workpiece, the workpiece is heated heterogeneously.

11. The method of claim 10, wherein the workpiece is selectively heated as a function of depth.

12. The method of claim 1, wherein an energy source is disposed adjacent to an entrance to the bore, and wherein applying the heat energy to the workpiece comprises activating the energy source to emit heat energy comprising the plurality of frequencies, the bore comprising a waveguide for propagation of the heat energy from the energy source to the workpiece.

13. The method of claim 12, wherein the bore is the waveguide.

14. The method of claim 12, wherein a separate conduit is disposed within the bore, the separate conduit being the waveguide.

15. The method of claim 12, wherein the waveguide comprises a circular transverse cross-section.

16. An apparatus for thermomagnetically processing a material, the apparatus comprising:

a high field strength magnet having a bore extending therethrough for insertion of a workpiece therein; and an energy source disposed adjacent to an entrance to the bore, the energy source being an emitter of variable frequency heat energy, wherein the bore comprises a waveguide for propagation of the variable frequency heat energy from the energy source to the workpiece.

17. The apparatus of claim 16, wherein the energy source is selected from the group consisting of: a microwave source, radiofrequency source, a millimeter wave source, an infrared source, a visible light source, an ultraviolet radiation source, and an acoustic source.

18. The apparatus of claim 16, further comprising a coupling attaching the energy source to the entrance.

19. The apparatus of claim 16, wherein the high field strength magnet comprises a superconducting magnet.

20. The apparatus of claim 16, wherein the bore is the waveguide.

21. The apparatus of claim 16, wherein a separate conduit is disposed within the bore, the separate conduit being the waveguide.

22. The apparatus of claim 16, wherein the waveguide comprises a circular transverse cross-section.

23. The apparatus of claim 16, wherein the workpiece comprises a material selected from the group consisting of: metal, ceramic, semiconductor, polymer, and organic or food product.

* * * * *